United States Patent [19]

Maskell et al.

[11] 4,052,776

[45] Oct. 11, 1977

[54] METHOD OF SPOT-KNOCKING AN ELECTRON GUN ASSEMBLY IN A COLOR TELEVISION PICTURE TUBE

[75] Inventors: Roy Maskell, Oak Park; Armando V. Marino, Chicago, both of Ill.

[73] Assignee: Zenith Radio Corporation, Glenview, Ill.

[21] Appl. No.: 728,108

[22] Filed: Sept. 30, 1976

[51] Int. Cl.[2] ..... H01J 9/02

[52] U.S. Cl. ..... 29/25.11; 316/26

[58] Field of Search ..... 29/25.11, 25.16; 316/26, 32, 1

[56] References Cited

U.S. PATENT DOCUMENTS

| | | | |
|---|---|---|---|
| 3,323,854 | 6/1967 | Palac | 316/1 |
| 3,357,766 | 12/1967 | Conger, Jr. | 316/1 |
| 3,434,770 | 3/1969 | Angelucci et al. | 316/1 |
| 3,698,786 | 10/1972 | Gronka | 29/25.11 |

*Primary Examiner*—Richard B. Lazarus
*Attorney, Agent, or Firm*—John R. Garrett

[57] ABSTRACT

This disclosure depicts a method of spot-knocking an electron gun having a heater and cathode, a control grid G1, a screen grid G2, and four main focus lens electrodes (G3, G4, G5, and G6), wherein a first relatively large gap exists between G2 and G3, between G3 and G4, between G4 and G5, and between G5 and G6, and a second relatively small gap exists between G1 and G2, and a third relatively very small gap exists between G1 and the cathode. The method of this invention involves: establishing the heater and cathode and, the G1 and G2 grids and the G3, G4 and G5 electrodes at substantially ground potential; applying a first fluctuating DC voltage to electrode G6 of a magnitude and for a time effective to cause arcs to occur between portions of the electrodes G5 and G6 so as to remove any particles of metal or contaminants on the electrodes; whereby the grounding of the heater and cathode, the G1 and G2 grids and the G3, G4 and G5 electrodes protects the heater and cathode, and the G1 and G2 grids from arcs caused by the first fluctuating DC voltage; establishing the heater and cathode, the G1 and G2 grids and the G4 electrode at substantially ground potential; applying a second fluctuating DC voltage with an amplitude less than the first fluctuating DC voltage, to electrodes G3, G5 and G6, of a magnitude and for a time effective to cause arcs to occur between portions of the electrodes G4 and G5, between portions of the electrodes G4 and G3, and between portions of the electrodes G2 and G3 so as to remove any sharp particles of metal or contaminants on portions of the G2, G3, G4 and G5 electrodes; whereby the grounding of the heater and cathode and the grounding of the G1 and G2 grids protects the heater and cathode from arcs caused by the second fluctuating DC voltage.

5 Claims, 7 Drawing Figures

METHOD OF SPOT-KNOCKING AN ELECTRON GUN ASSEMBLY IN A COLOR TELEVISION PICTURE TUBE

CROSS REFERENCE TO RELATED PATENT APPLICATION

This application relates to but is no way dependent upon, copending application of common ownership herewith, Ser. No. 494,123, filed Aug. 2, 1974(now U.S. Pat. No. 3,995,194).

BACKGROUND OF THE INVENTION

This invention relates in general to the manufacture of a color television picture tube having an electron gun mounted in a neck of the tube, and in particular to a method of spot-knocking the electron gun. Conventionally a color television picture tube has a glass bulb including a funnel, a faceplate sealed to the flared end of the funnel and an electron gun mounted in the funnel neck for providing a source of cathode rays. The electrode gun for a color television picture tube typically has a heater and cathode, a control grib G1, a screen grid G2, a focus electrode G3, and a high voltage elecrode G4 for each of the three color beams generated by the tube.

A color television picture tube may operate with a potential difference of the order of tens of kilovolts among its electrodes. In a tri-beam color tube the three electron gun structures are positioned in the neck of the tube in closely spaced relation and the beams from the guns are deflected by a common deflection field. The close spacing and high voltages cause color television picture tubes to be particularly susceptible to arcing which can make noise that is disturbing to the user of the tube or can cause current flow in the tube and associated circuitry which may damage the tube and/or television receiver.

Such arcing has been found to be largely a function of foreign matter or contamination within the tube, and of mechanical imperfections in the construction of electron guns in the tube. Some improvement in arcing characteristics can be achieved by careful cleaning of the gun parts before they are assembled. Additionally, it is helpful to employ a high voltage spot-knocking to melt metal projections on the guns or stray particles or foreign matter within the tube after the tube has been evacuated and sealed, so that these no longer tend to promote arcing.

In one form of spot-knocking, the cathode, the heater and the low voltage electrodes G1, G2 and G3 are grounded and a pulsed positive voltage, which peaks at about 200% of the normal ultor voltage, is applied to the high voltage electrode G4 for a predetermined amount of time to burn off the loose particles or the metal projections which may reside between the electrodes.

A unique electron gun is disclosed in the referent copending application. This disclosure depicts as electron gun having a heater and cathode, a control grid G1, a screen grid G2, and four main focus lens electrodes G3, G4, G5 and G6. The unique electron gun is characterized by having small gap sizes between the grids and electrodes as compared to a conventional electron gun. In addition, these small gap sizes have substantially larger potentials applied to them than in the conventional electron gun. Due to the small gap sizes and the high potentials applied to the grids and electrodes, it is necessary to spot-knock not only the G5–G6 gap, but also the G4–G5 gap and the G2–G3 gap. For this electron gun conventional spot-knocking techniques are impractical.

This invention is most advantageously applied to an electron gun of the character described and claimed in the referent copending application.

OTHER PRIOR ART

U.S. Pat. No. 3,321,263
U.S. Pat. No. 3,323,854
U.S. Pat. No. 3,434,770
U.S. Pat. No. 3,736,038
U.S. Pat. No. 3,966,287

OBJECTS OF THE INVENTION

It is a general object of the present invention to provide a method of spot-knocking an electron gun wherein the electron gun has a heater and cathode, a control grid G1, a screen grid G2, and four main focus lens electrodes G3, G4, G5 and G6.

It is another object of the present invention to provide a method of spot-knocking such an electron gun which removes particles of methal or contaminants on the four main focus lens, electrodes and a portion of the screen grid.

It is another object to prevent damage to the heater and cathode and to the control grid and screen grid of the electron gun during the spot-knocking procedure.

It is yet another object of the present invention to provide a simple and effective method of spot-knocking a portion of the screen grid G2, the main focus lens electrodes G3, G4, G5 and a portion of the G6 electrode of the electron gun.

BRIEF DESCRIPTION OF THE DRAWINGS

The features of the present invention which are believed to be novel are set forth with particularity in the appended claims. The invention, together with further objects and advantages thereof may best be understood by reference to the following description taken in conjunction with the accompanying drawings, in the several figures of which like numerals identify like elements, and in which FIGS. 1–4 schematically represent the method of the present invention of spot-knocking an electron gun having a heater and cathode, a control grid, a screen grid, and four main focus lens electrodes.

DESCRIPTION OF THE PREFERRED EMBODIMENTS

Figure 1:
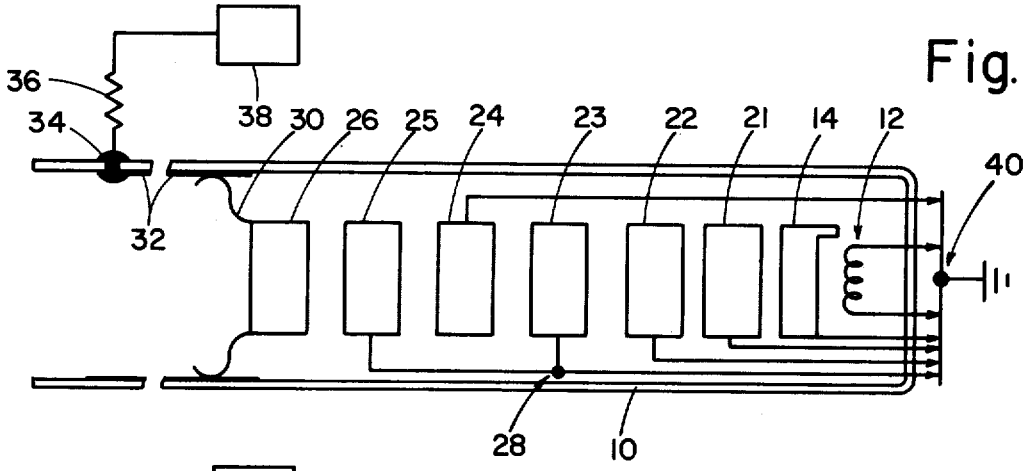
Figure 2:
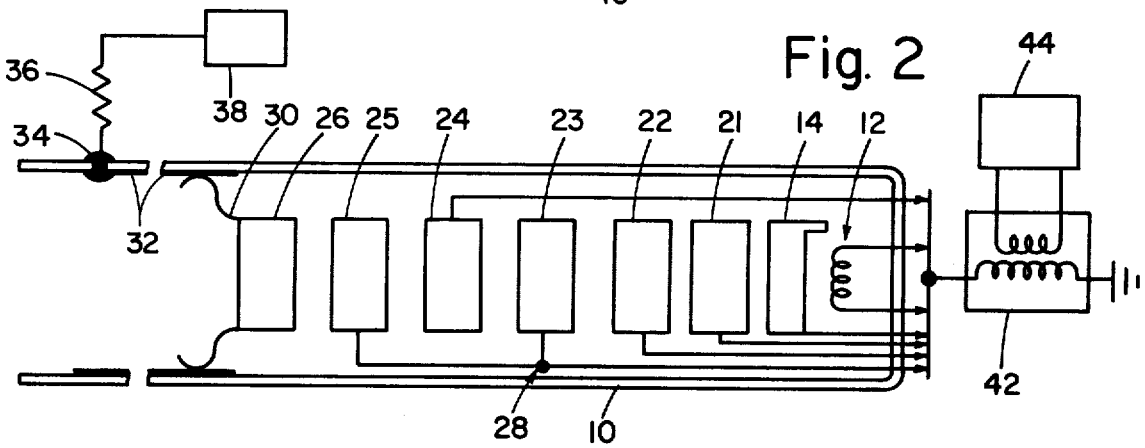

This invention pertains to a method of spot-knocking an electron gun in a color television picture tube. Whereas the invention may be used on electron guns of various types, it is preferably used on an electron gun of the nature shown in FIGS. 1–4. This electron gun is described and claimed in the referent copending application.

The electron gun is schematically illustrated in FIGS. 1–4. The electron gun shown comprises; a heater 12, a cathode 14, a G1 control grid 21, a G2 screen grid 22, and four main focus electrodes G3 (23), G4 (24), G5 (25), and G6 (26). The electron gun is mounted in a neck 10 of the color television picture tube.

A first, relatively large, gap exists between G2 and G3, between G3 and G4, between G4 and G5, and between G5 and G6. A second relatively small gap exists between G1 and G2, and a third relatively very small gap exists between G1 and the cathode. In this electron gun relatively large voltage potentials exist between the screen grid and the electrodes compared to the voltage potentials normally observed in a conventional electron gun. Although a number of the gaps are referred to as being relatively large, they are actually quite small in comparison to the gap size found in the conventional electron gun. In the conventional electron gun a G2–G3 gap size of 0.075 inches is typical with a voltage potential across it of approximately 4 kilovolts during normal tube operation. This combinatin of a large gap size with a relatively small voltage potential, thereacross eliminates the need for spot-knocking. Even when metal particles or contaminants exist on the electrodes there is little possibility of arcs occurring under these conditions. In the electron gun depicted in FIGS. 1–4, this is not the case. The following chart lists the approximate gap size and the approximate voltage potentials appearing across those gaps during operation of the illustrated electron gun.

| Gap | Gap Size | Voltage Potential Across Gap |
|---|---|---|
| Cathode-G1 | .040 inches | 190 V |
| G1–G2 | .008 inches | 1000 V |
| G2–G3 | .040 inches | 13 KV |
| G3–G4 | .040 inches | 7 KV |
| G4–G5 | .040 inches | 7 KV |
| G5–G6 | .040 inches | 17 KV |

In general terms the method of this invention involves: establishing the heater and cathode, the G1 and G2 grids and the G3, G4 and G5 electrodes at substantially ground potential; applying a first fluctuating DC voltage to electrode G6 of a magnitude and for a time effective to cause arcs to occur between portions of the electrodes G5 and G6 so as to remove any particles of metal or contaminants on the electrodes; whereby the grounding of the heater and cathode, the G1 and G2 grids and the G3, G4 and G5 electrodes protects the heater and cathode, and G1 and G2 grids from arcs caused by the firstfluctuating DC voltage; establishing the heater and cathode, the G1 and G2 grids and the G4 electrode at substantially ground potential; applying a second fluctuating DC voltage, the second fluctuating DC voltage with an amplitude less than the first fluctuating DC voltage, to electrodes G3, G5 and G6, of a magnitude and for a time effective to cause arcs to occur between portions of the electrodes G4 and G5, between portions of the electrodes G4 and G3, and between portions of the electrodes G2 and G3 so as to remove any sharp particles of metal or contaminants on the G2, G3, G4 and G5 electrodes; whereby the grounding of the heater and cathode and the grounding of the G1 and G2 grids protects the heater and cathode from arcs caused by the second fluctuating DC voltage.

A specific embodiment of the method of the present invention is depicted in FIGS. 1–4. In FIG. 1 the heater 12, the cathode 14, the control and screen grids 21 and 22, and three of the four main focus lens electrodes 23, 24 and 25 are grounded at point 40. Point 28 is an internal connection of electrode 23 and electrode 25. A source 38 of fluctuating DC voltage is connected by means of a current limiting resistor 36 to an anode button 34 located in the wall of the color television tube. The anode button 34 is electrically connected to electrode 26 by means of a graphite coating 32 on the inside wall of the tube and a snubber spring 30. Source 38 applies a first fluctuating DC voltage to electrode G6, causing arcs to occur between portions of electrodes 26 and 25, electrode 25 being at ground potential. The first fluctuating DC voltage will be described later.

In another step of the spot-knocking process (FIG. 2) an RF (radio frequency) source 44 is coupled by means of inductance device 42 for the purpose of applying a burst of RF across the G5–G6 gap in addition to the fluctuating DC voltage supplied by source 38.

Figure 3:
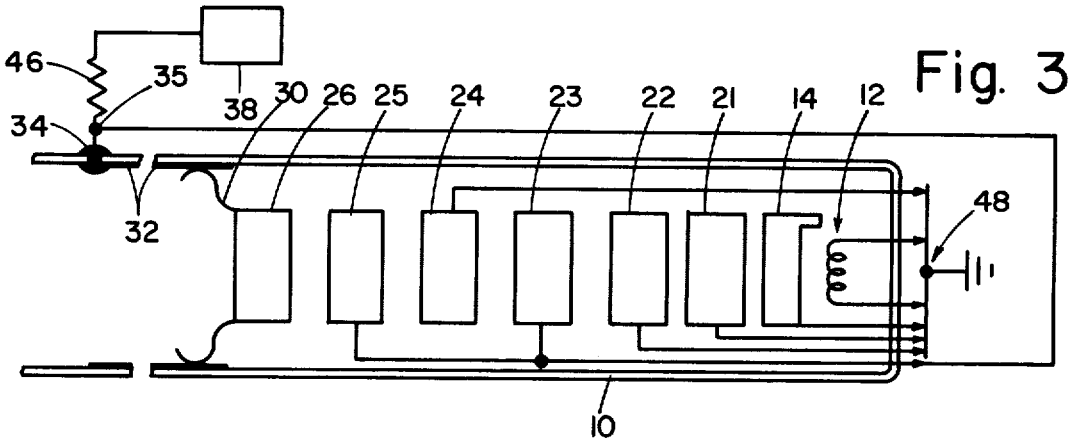

In FIG. 3 electrodes 23 and 25 are connected to point 35 which is connected to source 38 thru a current limiting resistor 46. The heater 12, cathode 14, control and screen grids 21 and 22 and electrode 24 are connected to ground potential at point 48. Source 38 applies a second fluctuating DC voltage through the current limiting resistor 46 to the anode button 34 which in turn energizes electrode 26 by means of the internal graphite coating 32 and snubber spring 30. Electrodes 25 and 26 are both energized by source 38. As a result, no arcs will occur between electrodes 25 and 26. However, arcs will occur between electrodes 24 and 25, electrodes 23 and 24, and electrode 23 and screen grid 22.

Figure 4:
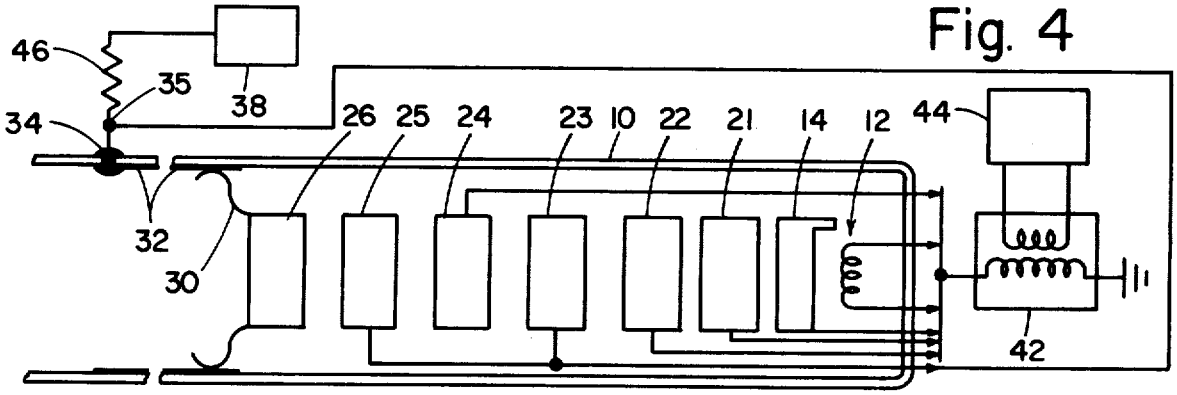

In FIG. 4 and RF (radio frequency) burst is added to the second fluctuating DC voltage from source 38 by an RF source 44 and inductive device 42.

The first and second fluctuating DC voltages will now be described. See FIGS. 5–7. The wave shapes of both voltages are similar, varying only in their amplitude and, therefore, a general description will be given which is applicable to both DC voltages.

Figure 5:
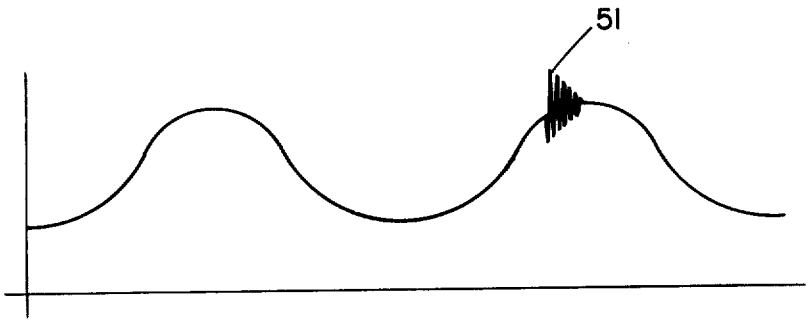
FIGS. 5–7 are graphs of fluctuating DC voltages which are applied to the electron gun shown in the FIGS. 1–4 drawings during the spot-knocking process.
Figure 6:
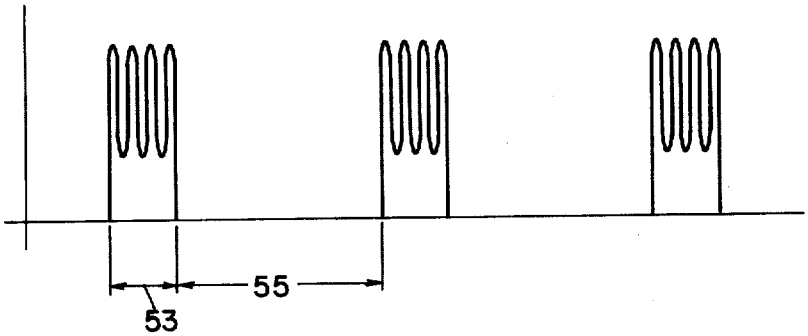

The waveform shown in FIG. 5 is a substantially half-wave voltage signal and has a frequency of 60 hertz. The half-wave voltage signal is modified in that the voltage amplitude does not return to a zero voltage level at any point. During portions of the spot-knocking method in which an RF burst 51 is added to the half-wave voltage signal the burst 51 occurs at the location on the wave shape shown in FIG. 5; it occurs on every other peak of the half-wave voltage signal.

During portions of the spot-knocking process, a first series of half-wave voltage signals is applied to the electron gun, the series differing only in the amplitudes of the half-wave voltage signals. In addition, these half-wave voltage signals are pulsed such that each of the half-wave voltage signals is on for a predetermined amount of time 53 and off for a predetermined amount of time 55. In the specific embodiment the half-wave voltage signals are pulsed such that they are on for one quater of a second and off for three quarters of a second. (See FIG. 6)

Figure 7:
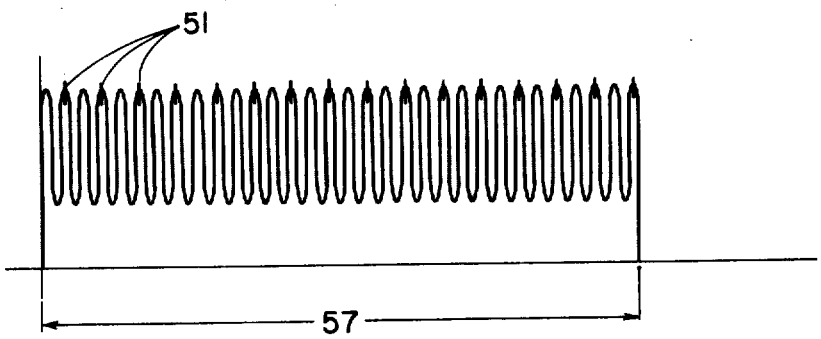

A second series of half-wave voltage signals is also applied to the electron gun, and has the RF burst 51 added to every other peak of each of the half-wave voltage signals, the signal being on for the entire predetermined time interval 57 as shown in the graph of FIG. 7. The RF burst 51 which is added to the half-wave voltage signals preferably has a frequency in the range of 300 to 400 kilohertz.

The following chart describes the half-wave voltage signals which are preferably used to form the first and second fluctuating DC voltages which are applied in the spot-knocking method. Chart 1 lists the amplitudes of the half-wave voltage signals and indicates whether an RF burst is added to every other peak or not, and in addition, lists the durations in seconds during which the half-wave voltage signals are applied to the electron gun.

Chart 2 lists the voltages used to form the second fluctuating DC voltage and Chart 3 lists an alternative embodiment of the spot-knocking method wherein the second fluctuating DC voltage has no RF burst added to the half-wave voltage signals.

| Chart I - First Fluctuating DC Voltage | | |
|---|---|---|
| Amplitude (KV) | Time Applied (sec) | RF Burst Added |
| 30 | 48 | No |
| 35 | 96 | No |
| 40 | 144 | No |
| 30 | 24 | Yes |
| 45 | 144 | No |
| 35 | 12 | Yes |
| 45 | 72 | No |
| 35 | 12 | Yes |
| 45 | 144 | No |
| **Chart II - Second Fluctuating DC Voltage** | | |
| Amplitude (KV) | Time Applied (sec) | RF Burst Added |
| 25 | 24 | No |
| 30 | 60 | No |
| 30 | 24 | Yes |
| **Chart III - Alternative Second Fluctuating DC Voltage** | | |
| Amplitude (KV) | Time Applied (sec) | RF Burst Added |
| 35 | 24 | No |
| 40 | 60 | No |

The invention is not limited to the particular details of the method depicted and other modifications and applications are contemplated. Certain changes may be made in the above described method without departing from the true spirit and scope of the invention herein involved. It is intended therefore that the subject matter in the above depiction shall be interpreted as illustrative and not in a limiting sense.

We claim:

1. For use in the manufacture of an electron gun having a heater and cathode, a control grid (G1), a screen grid (G2), and four main focus lens electrodes (G3, G4, G5 and G6) wherein a first relatively large gap exists between G2 and G3, between G3 and G4, between G4 and G5, and between G5 and G6, and a second relatively small gap exists between G1 and G2, and a third relatively very small gap exists between G1 and said cathode, a method for spot-knocking said electron gun comprising establishing said heater and cathode, said G1 and G2 grids and said G3, G4 and G5 electrodes at substantially ground potential;

applying a first fluctuating DC voltage to electrode G6 of a magnitude and for a time effective to cause arcs to occur between portions of electrodes G5 and G6, so as to remove any particles of metal or contaminants on said electrodes;

whereby said grounding of said heater and cathode of said G1 and G2 grids, and said G3, G4 and G5 electrodes protects said heater and cathode, and said G1 and G2 grids from arcs caused by said first fluctuating DC voltage;

in a separate and independent step, establishing said heater and cathode, said G1 and G2 grids and said G4 electrode at substantially ground potential and removing said ground potential from said G3 and G5 electrodes;

applying a second fluctuating DC voltage with an amplitude less than said first fluctuating DC voltage to electrodes G3, G5 and G6 of a magnitude and for a time effective to cause arcs to occur between portions of said electrodes G4 and G5, between portions of said electrodes G4 and G3 and between portions of said electrodes G2 and G3 so as to remove any sharp particles of metal or contaminants on said G2, G3, G4 and G5 electrodes;

whereby said grounding of said heater and cathode and said grounding of said G1 and G2 grids protects said heater and cathode from arcs caused by said second fluctuating DC voltage.

2. The method defined in claim 1 wherein said first fluctuating DC voltage comprises a first predetermined series of substantially half-wave voltage signals having different peak values, each of said signals being applied for a predetermined time interval and during said interval each half-wave voltage signal being pulsed such that said half-wave voltage signal is on for a predetermined amount of time and off for a predetermined amount of time.

3. The method defined in claim 2 wherein said first fluctuating DC voltage also comprises a second predetermined series of substantially half-wave voltage signals having different peak values, each of said signals being applied for a predetermined time interval, every other one of said second predetermined series of substantially half-wave voltage signals having an RF burst added to every other peak of said half-wave voltage signals having said RF burst, said signals in said second series without RF bursts being pulsed such that each of said half-wave voltage signals is on for a predetermined amount of time and off for a predetermined amount of time, said signals in said second series with RF bursts being on for said entire predetermined time interval.

4. The method in claim 1 wherein said second fluctuating DC voltage comprises a first predetermined series of substantially half-wave voltage signals having different peak values, each of said signals being applied for a predetermined time interval and during said interval each half-wave voltage signal being pulsed such that said half-wave voltage signal is on for a predetermined amount of time and off for a predetermined amount of time.

5. The method defined in claim 4 wherein said second fluctuating DC voltage also comprises a second substantially half-wave voltage signal having a predetermined peak value and being applied for a predetermined time interval, said second substantially half-wave voltage signal having an RF burst added to every other peak, and said signal being on for said entire predetermined time interval.

* * * * *